United States Patent [19]

Ludwig et al.

[11] 4,335,288

[45] Jun. 15, 1982

[54] ELECTRIC SWITCHING APPARATUS PARTICULARLY A CAM SWITCH

[75] Inventors: Bernd Ludwig, Marienheide; Jürgen Donner, Gummersbach, both of Fed. Rep. of Germany

[73] Assignee: Starkstrom Gummersbach GmbH, Marienheide, Fed. Rep. of Germany

[21] Appl. No.: 147,092

[22] Filed: May 5, 1980

[30] Foreign Application Priority Data

May 7, 1979 [DE] Fed. Rep. of Germany ..... 2918289

[51] Int. Cl.[3] ..... H01H 9/02

[52] U.S. Cl. ..... 200/307; 200/6 B; 200/153 LB; 200/291

[58] Field of Search ..... 200/16 A, 18, 243, 283, 200/284, 153 LB, 307, 303, 291, 6 B, 11 R

[56] References Cited

U.S. PATENT DOCUMENTS

| | | | |
|---|---|---|---|
| 3,188,404 | 6/1965 | Fichter | 200/307 |
| 3,201,533 | 8/1965 | Fredrickson | 200/307 |
| 3,286,070 | 11/1966 | Volker | 200/307 |
| 3,584,163 | 6/1971 | White | 200/291 |
| 3,614,363 | 10/1971 | Fujita | 200/307 |
| 3,866,008 | 2/1975 | Teruzzi | 200/307 |
| 4,016,387 | 4/1977 | Aberer | 200/303 |
| 4,133,990 | 1/1979 | Wanner et al. | 200/307 |

FOREIGN PATENT DOCUMENTS

| | | | |
|---|---|---|---|
| 517231 | 10/1955 | Canada | 200/16 A |
| 603062 | 6/1948 | United Kingdom | 200/16 A |

*Primary Examiner*—John W. Shepperd
*Attorney, Agent, or Firm*—Michael J. Striker

[57] ABSTRACT

The electric switching apparatus assembled of a plurality of consecutively arranged modular units, includes snap action arresting means integrally formed on opposite side walls of each unit. The arresting means includes frame-shaped resilient arresting pieces leveled with the upper surface of the assigned side wall and being at one edge thereof integrally connected thereto and cooperating with matching arresting points on the adjoining unit.

14 Claims, 11 Drawing Figures

ELECTRIC SWITCHING APPARATUS PARTICULARLY A CAM SWITCH

BACKGROUND OF THE INVENTION

The present invention relates generally to electric switches, and in particular to an electric switching apparatus such as a cam switch having a driving mechanism, a stop chamber unit and at least one switch chamber unit, each of the units having modular structure axially connectable to the driving mechanism.

An electric switching apparatus of this type designed for installation in an opening of a supporting plate, is known from the German publication No. 2,609,473. This known apparatus has a front part provided with a tubular neck having an outer thread and being insertable from the outside into the opening of the supporting plate up to a stop surface whereupon the neck is secured to the supporting plate by means of a counteracting annular nut applied on the threaded neck from the inside. In order to connect to the front part a block containing the electrical component part, the tubular neck is formed with two juxtaposed segments provided respectively on their free ends with arresting projections which are engageable with corresponding arresting grooves in the block. For this purpose the face of the block which is to be connected to the front part is provided with two openings corresponding in form to the cross section of the segments on the neck so that upon plugging the coupling segments of the front part into these openings the arresting projections on the segments engage the arresting grooves in the block. Transversely to the longitudinal central axis of the block there is also provided a guiding space including a transversely shiftable locking strap which engages the segments and holds the same in a fixed position in the block.

The disadvantage of such prior art switching apparatus is the fact that in order to shift the locking strap from one side into its locking position in contact with the arresting pieces and vice versa to release this locking strap in order to enable the disassembly of respective component parts, a relatively large space is necessary at lateral sides of the apparatus. Another substantial disadvantage of this prior art apparatus also resides in the fact that the segments formed on the tubular sleeve of the front part have to be introduced into the correspondingly shaped guiding openings in the front wall of the block and consequently both the segments and the arresting points cannot be observed and controlled from the outside. In other words, in the assembled condition of the switching apparatus it is impossible to reach the arresting pieces or to control the same, which means they cannot be checked in their arresting position, nor released from the outside from this arresting position. The laterally shiftable locking strap is therefore always necessary to ensure the arresting position of the front part and the block. As a consequence, a cumbersome manipulation is necessary during the assembly of individual component parts of the switching apparatus on the one hand and a relatively complicated design of the apparatus is necessary on the other hand.

SUMMARY OF THE INVENTION

It is therefore a general object of the present invention to overcome the aforementioned disadvantages.

More particularly, it is an object of the invention to provide an improved electrical switching apparatus in which the design of individual construction elements is simplified.

Another object of this invention is to provide such an apparatus which requires a smaller installation space than prior art apparatuses of this kind.

Still another object of this invention is to provide such an improved switching apparatus in which the structural units are easy to assemble and disassemble.

An addition object of the invention is to provide an electrical switching apparatus in which an arbitrary number of structural units can be employed whereby a reliable connection of all units is ensured.

In keeping with these objects and others which will become apparent hereafter, one feature of the invention resides in an electric switching apparatus of the above-described type, in the provision of resilient snap-action arresting means which are integrally formed in opposite side walls of respective construction units of the apparatus and including in each unit resilient arresting pieces and arresting points releasably engageable with the arresting pieces in the adjoining unit.

Preferably, the resilient arresting pieces are leveled with the outer surface of the assigned side wall and are provided with recesses which snap into the projecting arresting points in the adjoining unit. In the preferred embodiment of this invention, the flat arresting pieces have the form of a frame which is integrally connected at one side to the lateral wall of the unit and the arresting points are in the form of projections having a triangular cross section.

The remaining opposite walls of each unit serve for supporting electrical terminals which are arranged in inclined recesses provided with guiding channels for guiding a screwdriver.

In order to prevent angular displacement of respective units of the switching apparatus, the units are unsymmetrically shaped along their longitudinal axis.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
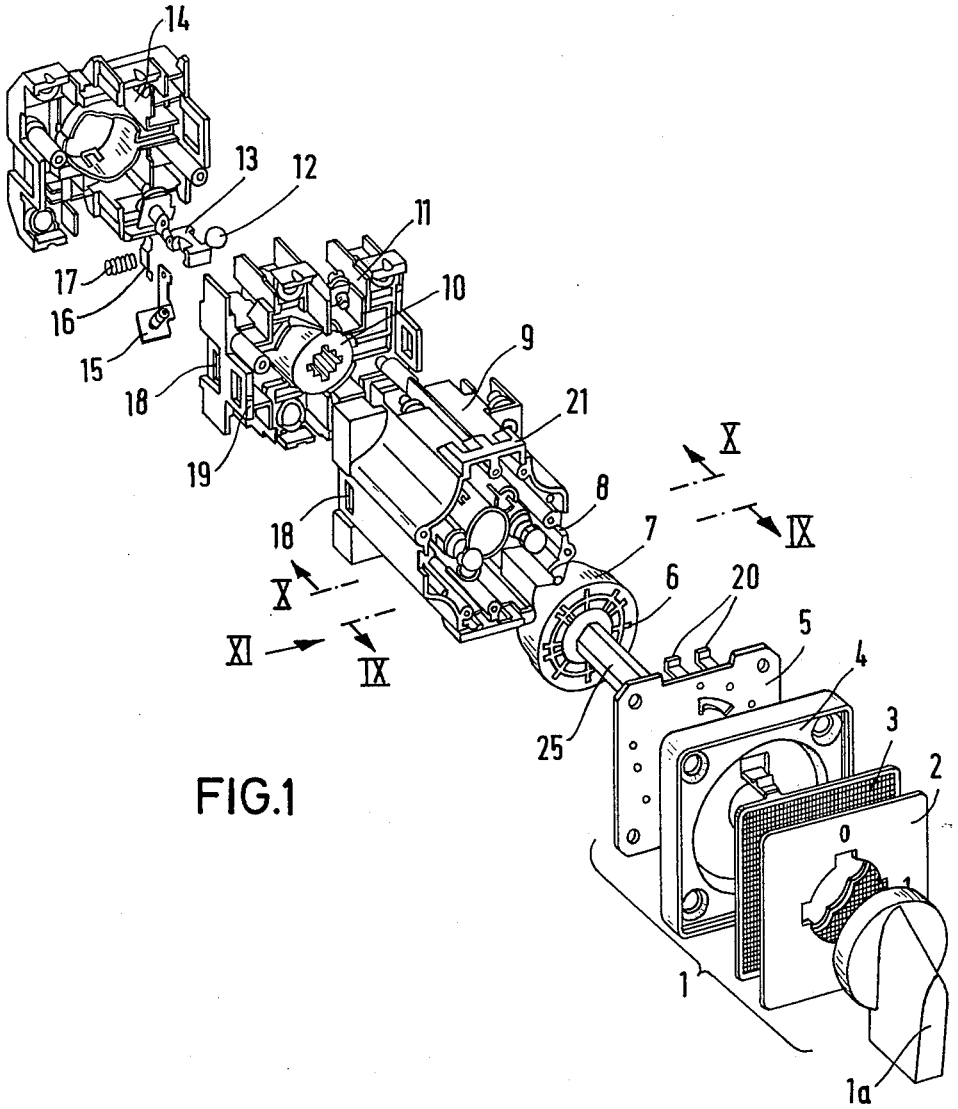
FIG. 1 is an exploded perspective view of a cam switch including a plurality of interconnectable modular units.

Referring to FIG. 1, there is illustrated a structure of an electrical switching apparatus, namely of a cam switch according to this invention. The switch includes a plurality of mutually connectable construction elements or units, namely a driving mechanism, a stop chamber unit and one or more switch chamber units. The driving mechanism 1 in this example includes a hand operated control knob 1*a*, a marking plate 2, a stop plate 3, front cover plate 4 and an attachment or bracket plate 5. The whole driving unit 1 is held together in such a manner that the control knob 1*a* is secured to the end of a rotary shaft 25 while the notch wheel 7 holds respective component parts of the driving unit 1 in the front cover plate 4. The length of the rotary shaft 25 is adjusted such as to support also the control cylinders in respective switch chamber units as it will be explained below.

A detent chamber unit 9 adjoins the driving unit 1 and includes substantially the aforementioned notch wheel 7, stop pin 6 and arresting springs 8 for arresting balls which cooperate with the notch wheel 7.

One or more switch chamber units 11 adjoint the detent chamber unit 9. Each switch chamber unit 11 includes a control cylinder 10 as well as electrical contact assembly. The control cylinder 10 cooperates with glass balls 12 which can be replaced also by a suitably shaped plunger 32 of plastic material formed at its end with a spherical surface. When glass balls 12 are used, it is necessary to provide for special plungers or pushers 13 interposed between the balls 12 and contact bridges 16 spring biased by pressure springs 17. The contact bridges 16 cooperate with stationary contact bars 15 in the switch chamber 11. The switching apparatus is terminated with rear cover plate 14. The aforedescribed modules or structural units 1, 9 and 11 of the switching apparatus are releasably connected one to another by means of outer arresting means provided on opposite lateral walls of respective structural units and including lateral resilient or elastic arresting pieces 19 or 22 cooperating with arresting points 18 or 23 in the adjoining unit so that the arresting means are observable and accessible from the outside.

Figure 2:
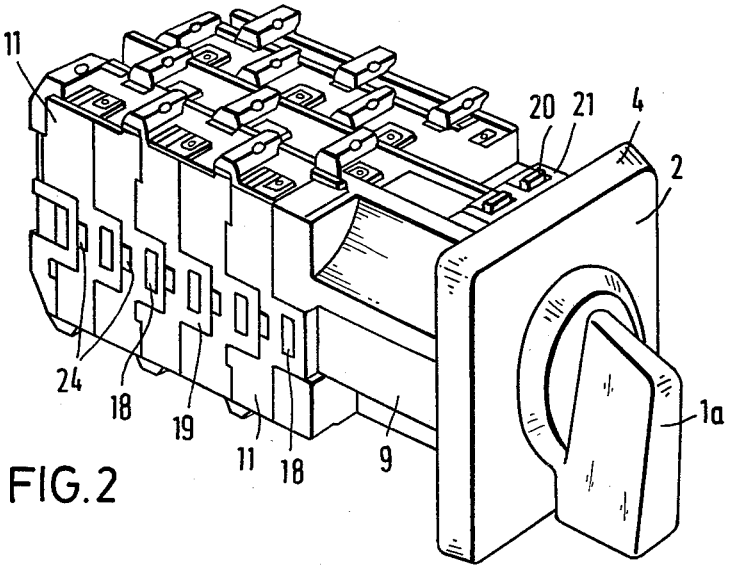
FIG. 2 is a perspective view of the switch of FIG. 1 in its assembled condition.

As seen from FIGS. 1 and 2, the resilient or elastic arresting pieces in each unit include juxtaposed flat tongues 19 leveled with the outer surface of the assigned lateral walls and being provided with recesses for engaging arresting points 18 in the adjoining units to be connected. Preferably, resilient flat tongues or straps 19 have a frame-like configuration whereas the arresting points 18 have the shape of projections engaging the opening of the frame-like tongues 19. Preferably, the projecting arresting points 18 have a triangular transverse cross section so that the inclined surface of the arresting points during engagement with the arresting tongues 19 bends the latter outwardly, and upon completion of the axial arresting movement the inner elasticity of the frames 19 snaps back the same against the arresting surface of the projections 18.

As seen from FIG. 2, the arresting means include also recesses 24 formed in the lateral wall of respective units opposite the front edge of the arresting frame 19 for receiving a screwdriver or similar tool which unlocks the frames from the projections 18.

It is also of particular advantage when the structural units 1, 9 and 11 have asymmetric configuration which prevents the rotation of the units relative to each other. In other words, the asymmetry of the structural units permits the assembly of the switch only in one predetermined position in which the units plug in a very simple manner one into the other.

The connection between the bracket plate 5 of the driving unit 1 to the adjoining detent chamber unit 9 is made by means of a resilient yoke 22 formed on a bottom side of the detent chamber unit 9 (FIG. 3) and defining two recesses which engage angular projections 23 formed on the mounting bracket plate 5. The opposite or top wall of the detent chamber unit 9 is formed with a rigid yoke 21 which engages two additional outwardly bent projections 20 on the bracket plate 5. During the assembly of the switching apparatus, the latter angular projections 20 are brought into engagement with the rigid yoke 21 whereupon the driving unit 1 is turned toward the stop chamber unit 9 and the angular projections 23 are brought into engagement with the resilient yoke 22 so that the mounting bracket plate 5 tightly engages the corresponding face of the detent chamber 9.

As to the overall structure of the above-described cam switch it will be noted the following:

The wiring of prior art cam switches have encountered many problems due to the fact that the binding bolts have been arranged radially in a restricted space of the apparatus and the connection frequently could be made only by the aid of additional angular connections. The configuration of the cam switch of this invention by contrast offers the possibility to arrange all binding screws on the two opposite sides of respective structural units which do not include the aforedescribed arresting tongues 19 and arresting points 18. Due to the novel arrangement of binding posts onto opposite walls of each unit a switch block results which is assembled of one or more structural units each having a substantially rectangular configuration and the binding posts are formed in a mutually staggered formation. In this manner, all binding posts no matter how restricted the installation space may be, are freely accessible to the wiring worker and any additional guiding angles can be dispensed with.

Figure 3:
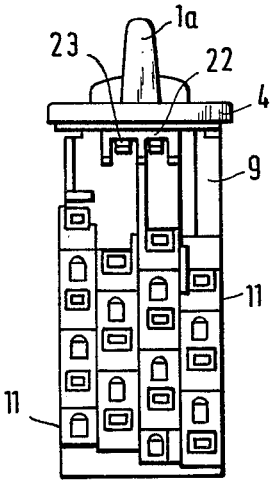
FIG. 3 is a simplified bottom view of the switch of FIG. 2.

As seen from FIG. 3, each binding screw terminal is inclined relative to the upper surface of the assigned structural unit and there are provided guiding partitions for a screwdriver so that during wiring the screwdriver is exactly guided and centered against the screw head even when electrical or pneumatical screwdriving devices are used. In this manner any slipping of the screwdriver, the damage or unreliable connections are eliminated. As a consequence, a considerable reduction of the working time for the wiring operation is achieved.

It is also of advantage when the binding posts include resilient clamping discs provided with additional clamping serrations in order to ensure a reliable hold of the conductors. The switch chamber units are completely sealed and prevent therefore any penetration of dust, insulating or foreign particles and also prevent an unintentional projection of the connected conductors into the inner contact space of each unit.

The switching program is determined by means of an exchangeable control cylinder of a solid material which can be made common for all switch chamber units or divided for each separate switch chamber unit. The control cylinder cooperates with the aforementioned balls or plungers which in turn move the assigned contact bridge. The control cylinder is provided on its cylindrical surface with spherical recesses arranged in accordance with a desired switching program to connect or disconnect the contact bridges from the assigned contact bars. In this manner, each actuation ball or plunger is coupled to one spring biassed contact bridge. During the rotation of the control cylinder the ball or the spherical end surface of the plunger engage and disengage the corresponding spherical openings in the periphery of the cylinder and displace the contact bridge into or from the contact rails or bars. The balls with their push rods are guided in a cage so as to remain always united with the biassing spring and the contact bridges and do not separate when the control cylinder is removed. In this manner, each switch chamber unit represents a closed functional unit.

This arrangement has the advantage that the assembly of the switching apparatus can be successfully made even by an unskilled worker and also complicated switching programs can be established in a most simple manner by the control designer inasmuch as it is only necessary to provide the solid control cylinder with semispherical bores made according to a predetermined development or switching diagram on corresponding locations. By employing a solid control cylinder the angular and axial displacements which hitherto have been usual in conventional cam wheels, are eliminated.

The detent chamber unit with the notch wheel has also a very simple structure. It includes steel balls cooperating with the notch wheel of a plastic material (FIG. 1) in such a manner that by a simple redistribution of these steel balls the switching angle can be changed. It is therefore possible to introduce into the switching apparatus a large variety of switching programs. Mechanical wear in the stop chamber is reduced to minimum.

FIGS. 4 through 11 serve for a better understanding of the embodiment of this invention as illustrated in FIGS. 1 through 3. Like component parts are designated by like reference numerals.

Figure 4:
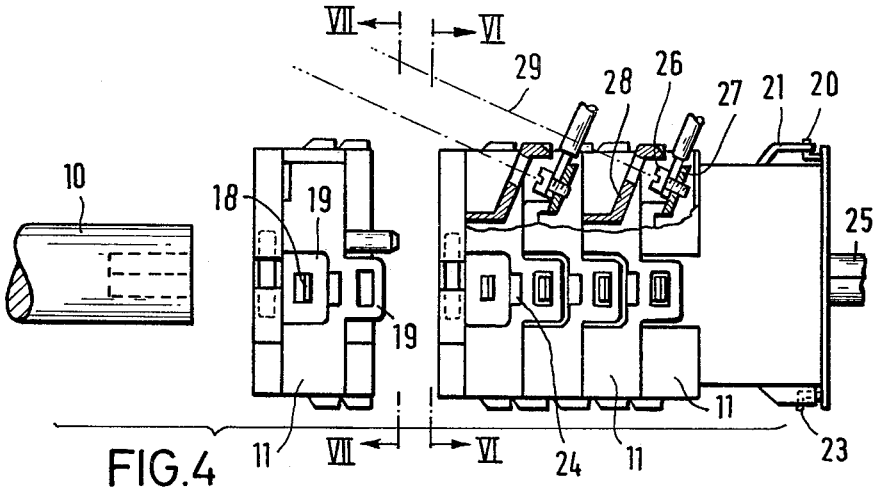
FIG. 4 is a side view of a cutaway part of the switch of FIG. 2 wherein a switch chamber unit is removed from the rest of the switch and the control shaft is pulled out.
Figure 5:
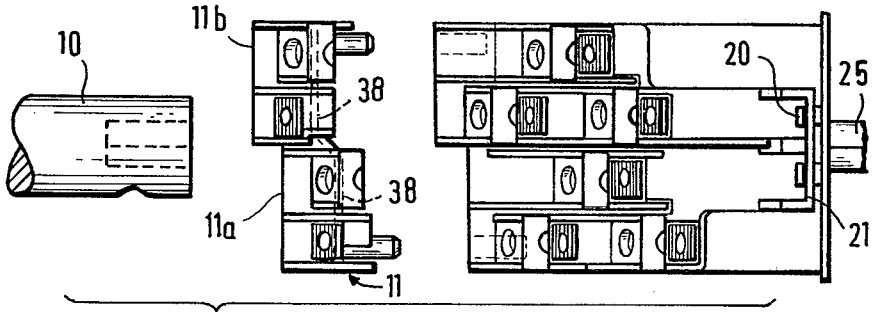
FIG. 5 is a top view of the switch of FIG. 4.

Referring now to FIGS. 4 and 5, it will be seen that respective switch chamber units 11 are subdivided in axial direction in two halves 11*a* and 11*b* which are axially shifted relative to each other whereby each switch chamber unit is manufactured of a single piece, for example, by pressing. Also, the frame-shaped arresting pieces 19 are staggered relative to each other in accordance with the axial shift of the two halves of the switch chamber unit. The frame-like arresting pieces 19 have the configuration of flat spring shackles leveled with the outer surface of the assigned lateral wall of the switch chamber unit. Also, the arresting points 18 are staggered accordingly so as to engage the asymmetrically arranged resilient arresting piece 19 of the adjoining switch chamber unit.

It will be also seen from FIG. 4 that the binding screws 26 together with the stationary binding bar 27 and with the screwdriver guiding partitions 28 are inclined relative to the outer surface of the switch chamber unit. The screwdriver, during the wiring operation, is therefore guided in an oblique direction as indicated by the dash lines 29 and the wiring worker therefore is capable of working without obstacles even in a very limited installation space.

Figure 6:
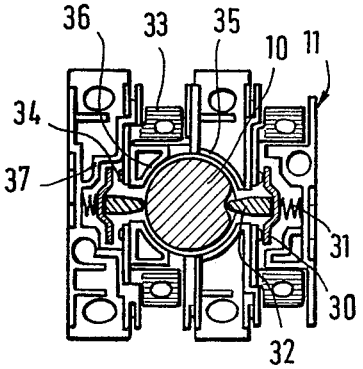
FIG. 6 is a sectional front view of the switch of FIG. 4 taken along the line VI—VI.
Figure 7:
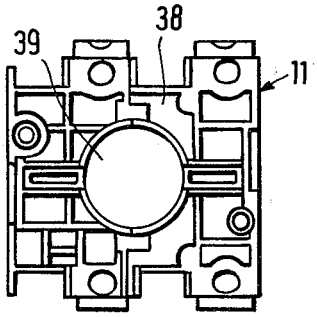
FIG. 7 is a sectional rear view of the switch of FIG. 4 taken along the line VII—VII.
Figure 8:
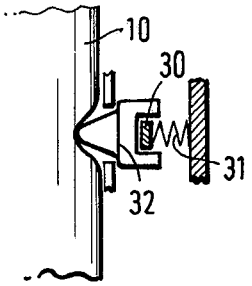
FIG. 8 is a detail view of a cutaway part of the switch of FIG. 6 shown on an enlarged scale.
Figure 10:
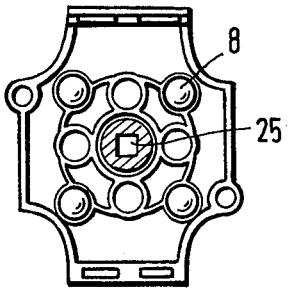
FIG. 10 is a sectional front view of a unit of FIG. 1 taken along the line X—X.
Figure 9:
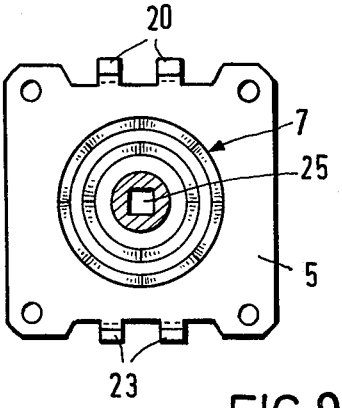
FIG. 9 is a sectional rear view of a unit of the switch of FIG. 1 taken along the line IX—IX.
Figure 11:
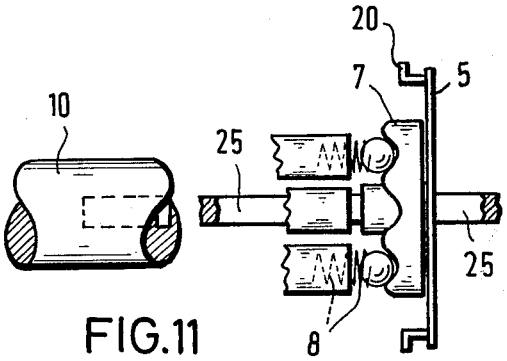
FIG. 11 is a cutaway side view in the direction of arrow XI of a part of the switch of FIG. 1.

The switch chamber units, as seen from FIGS. 6 and 7, include axially directed intermediate or guiding partitions 35, 36 and 37 which are shaped also for holding in position the freely insertable contact bars 33 and 34 as well as the biassing springs 31, contact bridges 30 and plungers 32.

The sides of the switch chambers 11 which face each other in axial direction of the shaft 25 are open and the side adjoining the rear cover plate 14 as well as the interior of the plate 14 are provided with additional intermediate and guiding partitions as illustrated in FIG. 7. In this manner, the loosely inserted contact parts, that means the movable contact pieces 30 as well as the contact pressure springs 31, plungers 32 and contact bars 33 with rigidly connected contact discs 34 are held in their operative positions as soon as the intermediate and guiding partitions of respective switch chambers 11 and cover plates 4 and 14 are fitted together and snapped by the arresting means 18 and 19.

The arrangement of this invention brings about the substantial advantage that the individual component parts of the switching apparatus can be manufactured at very low costs and also the assembly time is considerably decreased while upon the assembly of the switching apparatus the control cylinder or cylinders can be removed at will without the danger of loosening the remaining component parts and electrical contacts in the switch chambers.

Referring now to FIGS. 11, 9, 10 and 1, it will be seen that the component parts for the interconnection of the driving unit 1 with the stop chamber unit 9 are made in such a manner as to transfer both the axial and the tangential forces applied to the detent chamber unit 9. The axial forces act against arresting balls 8 in the direction of their biassing springs which are arranged parallel to the axis of the driving shaft 25 to press the balls against the notch wheel 7. The tangential forces result from the rotation of the driving shaft 25 and are transmitted to the arresting balls 8 via the wheel 7.

Referring again to FIGS. 6 and 7, in the preferred embodiment of this invention the intermediate guiding partitions 35, 36 and 37 are interconnected by an intermediate wall 38 extending in a plane transverse to the axis of rotation of the control cylinder 10 which in this case passes through a circular opening 39 in the wall 38.

It will be understood that each of the elements described above, or two or more together, may also find a useful application in other types of constructions differing from the types described above.

While the invention has been illustrated and described as embodied in a switching apparatus in the form of a cam switch, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An electric switching apparatus, particularly a cam switch including a driving unit, a detent chamber unit, and at least one switch chamber unit, said units having a modular construction and being consecutively arranged in axial direction one after the other, comprising snap action arresting means integrally formed on opposite side walls of each unit and including on respective side walls resilient arresting pieces, and rigid arresting points, said points on one unit being releasably engageable with the arresting pieces in the adjoining unit, and recesses formed in said side walls of respective units opposite the free edge of each arresting piece to accommodate a screwdriver-like tool for lifting said arresting pieces during the disassembly of respective units, said side walls in each unit being asymmetrically staggered relative to each other to define a central step for preventing angular displacement of said unit.

2. An electric switching apparatus as defined in claim 1, wherein said resilient arresting pieces are in the form of flat straps leveled with the upper surface of the assigned side wall and being at one side integrally connected to said unit.

3. An electric switching apparatus as defined in claim 2, wherein said flat straps have a frame-like configuration and said arresting points are in the form of projections matching said frame-like arresting pieces.

4. An electric switching apparatus as defined in claim 3, wherein said arresting projections have a triangular cross section defining a sloping side for lifting the assigned resilient arresting piece and a perpendicular side for locking said arresting piece.

5. An electric switching apparatus as defined in claim 1, wherein said driving unit includes a bracket plate provided on two opposite sides thereof with a pair of angular projections, said detent chamber unit being provided on its top and bottom sides with yokes each defining a pair of recesses for engaging said angular projections on the bracket plate of said driving unit.

6. An electric switching apparatus as defined in claim 5, wherein one of said yokes is resilient and the other yoke is rigid.

7. An electric switching apparatus as defined in claim 1, including a plurality of switch chamber units each having one half of its housing shifted in axial direction relative to the other half of its housing whereby said resilient arresting pieces and said rigid arresting points on one side wall of the housing of each unit are correspondingly staggered relative to those on the opposite side wall.

8. An electric switching apparatus as defined in claim 1, wherein said driving unit includes a driving shaft and said switch chamber unit includes a control cylinder driven by said driving shaft, guiding partitions surrounding said control cylinder, contact bars insertable into each switch chamber unit and being held in position by said partitions, a spring biassed contact bridge movable in a space delimited by said partitions and plunger means disposed between said control cylinder and said contact bridge to move the latter into engagement and out of engagement from said contact bars.

9. An electric switching apparatus as defined in claim 8, further including a front cover plate enclosing said driving unit and a rear cover plate, said rear cover plate having side walls provided with said snap action arresting means and having an open rear wall for removing said control cylinder without disassembling said contact bars, said contact bridges and said biassing springs.

10. An electric switching apparatus as defined in claim 9, wherein said switch chamber unit includes an intermediate wall extending perpendicularly to the axis of said control cylinder and supporting said guiding partitions.

11. An electric switching apparatus as defined in claim 8, wherein said detent chamber unit includes a notch wheel mounted on said driving shaft and a plurality of spring biassed balls engaging in axial direction said notch wheel and being subject during the rotation of said driving shaft to axial and tangential forces.

12. An electric switching apparatus, particularly a cam switch including a drying unit, a detent chamber unit and a plurality of switch chamber units, said units having a modular construction and being consecutively arranged in axial direction one after the other, comprising snap action arresting means integrally formed on opposite side walls of each unit and including on respective side walls resillient arresting pieces and rigid arresting points, said points on one unit being releasably engageable with the arresting pieces in the adjoining unit, each of said plurality of switch chamber units having staggered lateral sides of its housing interconnected by resilient arresting pieces engaging rigid arresting points on the adjoining unit, the chamber unit being coupled to said driving unit by means of yokes provided on the top and bottom sides of the detent chamber unit and engaging angular projections on said driving unit, and each of said switch chamber units having binding posts arranged on its top and bottom sides.

13. An electric switching apparatus as defined in claim 12, wherein said binding posts include recessed contact bars and binding screws engaging said contact bars and being inclined relative to said top and bottom surfaces of the unit and said binding posts in one half of each unit being staggered relative to the other half of said unit.

14. An electric switching apparatus as defined in claim 13, wherein each of said recesses includes inclined partitions defining openings facing said inclined binding screws to guide a screwdriver through the latter.

* * * * *